US010745159B2

(12) United States Patent
Krumrey et al.

(10) Patent No.: US 10,745,159 B2
(45) Date of Patent: Aug. 18, 2020

(54) METHOD FOR PRODUCING A PACKED FILTER TOW BALE

(71) Applicant: Rhodia Acetow GmbH, Freiburg im Breisgau (DE)

(72) Inventors: Thomas Krumrey, Teningen (DE); Dietmar Kern, Malterdingen (DE)

(73) Assignee: Rhodia Acetow GmbH, Freiburg im Breisgau (DE)

( * ) Notice: Subject to any disclaimer, the term of this patent is extended or adjusted under 35 U.S.C. 154(b) by 365 days.

(21) Appl. No.: 15/569,847

(22) PCT Filed: Apr. 28, 2016

(86) PCT No.: PCT/EP2016/059544
§ 371 (c)(1),
(2) Date: Oct. 27, 2017

(87) PCT Pub. No.: WO2016/174162
PCT Pub. Date: Nov. 3, 2016

(65) Prior Publication Data

US 2018/0305052 A1 Oct. 25, 2018

(30) Foreign Application Priority Data

Apr. 29, 2015 (EP) ..... 15165662

(51) Int. Cl.
*B65B 27/12* (2006.01)
*B65B 11/58* (2006.01)
*B65B 51/10* (2006.01)

(52) U.S. Cl.
CPC ..... *B65B 27/125* (2013.01); *B65B 11/585* (2013.01); *B65B 51/10* (2013.01)

(58) Field of Classification Search
CPC ..... B65B 11/02; B65B 11/50; B65B 11/58; B65B 27/12; B65B 27/125; B65B 49/00; B65B 49/08; B65B 51/10; B65B 63/02
(Continued)

(56) References Cited

U.S. PATENT DOCUMENTS 2,937,484 A * 5/1960 Wiman ..... B65B 27/12 53/138.6
4,157,754 A 6/1979 Bartsch et al.
(Continued)

FOREIGN PATENT DOCUMENTS

CN 1184453 A 6/1998
CN 1646391 A 7/2005
(Continued)

OTHER PUBLICATIONS

Japanese Patent Office Action for Application No. 2017556606, with English Translation, dated May 7, 2019, 14 pages.
(Continued)

*Primary Examiner* — Hemant Desai
*Assistant Examiner* — Christopher Robin Kim
(74) *Attorney, Agent, or Firm* — Michael Best & Friedrich LLP

(57) ABSTRACT

The present invention relates to a method for producing a packed bale of highly compacted filter tow material. A compressed filter tow bale is first provided in cuboid shape in a baler. Then the compressed filter tow bale is packaged, having an air-tight packaging sleeve fully enclosing the compressed filter tow bale. According to the invention, the packaging sleeve is applied to the compressed filter tow bales such that at least 80%, preferably at least 90% and more preferably at least 95%, of the packaging sleeve is directly adjacent to the highly compacted filter tow material
(Continued)

and touches, or is at least spaced less than 15 mm from, the highly compacted filter tow material.

18 Claims, 2 Drawing Sheets

(58) Field of Classification Search
USPC ..... 53/436, 438, 461, 463, 465, 523, 526, 53/527, 528, 529, 203, 210, 218
See application file for complete search history.

(56) References Cited

U.S. PATENT DOCUMENTS

| | | | | |
|---|---|---|---|---|
| 4,577,752 | A | 3/1986 | Meredith, Jr. | |
| 5,369,935 | A * | 12/1994 | Lang | B65B 27/125 53/176 |
| 5,460,590 | A | 10/1995 | Greiner et al. | |
| 5,732,531 | A * | 3/1998 | de Silva | B65D 85/07 53/416 |
| 8,161,716 | B2 | 4/2012 | Takashi et al. | |
| 10,144,543 | B2 * | 12/2018 | Caenen | B65B 11/48 |
| 2005/0161358 | A1 * | 7/2005 | Kern | B31C 13/00 206/388 |
| 2011/0023898 | A1 * | 2/2011 | Hibi | B65B 27/125 131/328 |

FOREIGN PATENT DOCUMENTS

| | | | |
|---|---|---|---|
| CN | 101252850 | A | 8/2008 |
| CN | 101636330 | A | 1/2010 |
| DE | 7635849 | U1 | 3/1977 |
| DE | 3819854 | A1 | 1/1989 |
| DE | 10029503 | A1 | 1/2002 |
| EP | 0771741 | A1 | 5/1997 |
| EP | 2407387 | B1 | 1/2012 |
| JP | 2010-254376 | A | 11/2010 |
| KR | 10-2004-0104612 | A | 12/2004 |
| WO | 2002032238 | A2 | 4/2002 |
| WO | 2003/089309 | A2 | 10/2003 |
| WO | 2007/001810 | A1 | 1/2007 |

OTHER PUBLICATIONS

International Search Report and Written Opinion dated Aug. 6, 2016.
Korean Patent Office Action for Application No. 10-2017-7034455 dated Dec. 24, 2019 (9 pages, English translation included).

* cited by examiner

METHOD FOR PRODUCING A PACKED FILTER TOW BALE

CROSS-REFERENCE TO RELATED APPLICATIONS

This application is a national phase of PCT Application Number PCT/EP2016/059544 filed Apr. 28, 2016, which claims priority to European Patent Application EP15165662.6 filed Apr. 29, 2015, the entire contents both of which are hereby incorporated by reference herein.

BACKGROUND

The majority of cigarette filters used today are made of filter tow material consisting of endless cellulose-2.5-acetate filaments. After the spinning process, the individual filaments are combined into a band and subsequently crimped in a stuffer box. The product is subsequently dried and then loosely placed into filling cans with a height of several meters. During this process, the filter tow material is uniformly distributed over the cross-sectional area of the filling can due to longitudinally and laterally changing motions of a depositing unit. The layers are placed on top of one another until the filter tow package has reached the desired mass and height in the filling can. Conventional package weights in this field amount to several hundred kilograms. Subsequently, the filter tow material placed into the filling cans is compressed into a filter tow bale and ultimately packaged for the transport to the filter or cigarette manufacturer.

Depending on the bale format, the bales to be processed into cigarette filters have a weight between 350 and 650 kg, and very dense bales with weights up to 900 kg or so-called "high-density tow bales," e.g. of the type described in publication U.S. Pat. No. 4,577,752 A, are also available in exceptional cases.

After the transport of the packaged filter tow bales to the filter or cigarette manufacturer, the filter tow material is withdrawn from the bale and processed into filter rods in a filter rod machine, e.g., of the type described in publication U.S. Pat. No. 5,460,590 A.

During the processing of filter tow material into filter rods in a filter rod machine, the filter tow material is fluffed up as much as possible in a conditioning section. In order to fluff up the filter tow material, it is typically pulled apart by means of pneumatically operated spreader nozzles and drawn out with a system of drawing rollers, particularly with threaded or screw-like surfaces. Subsequently, the spread-out filter tow material is fed to a triacetin spray box, in which the acetate surface of the filter tow material is dissolved and tackified. The filter tow band is gathered and compressed to the cross section of the future filter rod in the formatting section of the filter rod machine. During this process, the filaments conglutinate and form a three-dimensional network structure with the desired filter hardness for further processing and the consumers.

In this context, the important quality characteristic for the filter or cigarette manufacturer is the homogeneity with respect to the tensile strength because the taste sensation of the smoker and the filtration capacity can be affected thereby. The still acceptable tensile strength dispersions are dependent on the absolute value of the tensile strength.

The homogeneity of the filter rods or the tensile strength is not only defined by the quality of the filter tow material and the processing method in the filter rod machine, but particularly also by the type of packaging of the filter tow material. In this context, the type of packaging of the filter tow material is typically decisive for an undisturbed withdrawal of the filter tow material from the filter tow bale and its transport to the filter rod machine.

Withdrawal-related problems frequently occur on the filter rod machine, in particular, when processing filter tow bales with high packing densities and filter tow bales, the material of which was subjected to excessively high compressive forces (for example during the compression process or locally due to strappings). Tension changes during the withdrawal of the filter tow material from the filter tow bale frequently lead to uneven prestressing of the filter tow material at the intake into the filter rod machine and therefore to material and tensile strength fluctuations.

In order to ensure that the filter rods produced of the filter tow material always have the same high quality, certain conditions therefore have to be taken into account, in particular, when the filter tow material is packaged so as to prevent excessive material or tensile strength fluctuations from occurring during the subsequent transport of the filter tow material from the filter tow bale to the filter rod machine.

On the one hand, a maximum compressive force cannot be exceeded during the compression of the filter tow material placed into the filling can because this would inevitably affect the quality of the filter tow material negatively in that the filter rods produced of the filter tow material would no longer have acceptable tensile strength fluctuations for the filter or cigarette manufacturer.

In addition, the use of strappings on the packaged filter tow bale should—whenever possible—be avoided because such strappings inevitably result in constrictions and local defects, which once again lead to unacceptable tensile strength dispersions of the filter rods produced of the filter tow material for the filter or cigarette manufacturer.

The effect of the method used for packaging filter tow material at the filter tow manufacturer on the quality of the filter rods produced of the packaged filter tow material in the filter rod machine at the filter or cigarette manufacturer was not or at least not sufficiently taken into account in currently used packaging methods known from the prior art.

A method for optimally filling a filling can is described in publication WO 02/32238 A2. However, this prior art primarily concerns only the filling of the filling can with filter tow material in order to subsequently prevent or at least reduce problems resulting from filter tow material, which was not optimally placed into the filling can, at the filter or a cigarette manufacturer.

The effect of the subsequent packaging process on the quality of the filter tow material is not sufficiently taken into account in this prior art. In this context, the packaging process on the one hand includes the compression of the filter tow material placed into the filling can and on the other hand the subsequent packaging of the compressed filter tow material into a packaged filter tow bale.

After the filter tow material has been placed into a filling can, the filter tow material is usually compressed in a baling press in the direction of the stacked layers of the filter tow material, which was previously placed into the filling can. During the compression process, a press ram 10, 10' of the baling press acts upon the filter tow material in the direction of its stacked layers such that the initial height of the layered filter tow material placed into the filling can is reduced.

During the compression process, the filter tow material does not behave in a completely elastic (reversible) fashion because the layered filter tow material placed into the filling can does not expand to its original height again once the press ram 10, 10' of the baling press no longer exerts the corresponding compressive force vertically upon the filter tow material layers. In fact, the height to which the filter tow material expands again once the compressive force exerted by the press ram 10, 10' of the baling press ceases to act upon the filter tow material particularly depends on the duration and the compressive force of the preceding compression process.

In order to package the filter tow material compressed in the filling can, it is common practice to wrap the filter tow package, which is still under compressive stress, with a packing material (packaging material), particularly within the press. After the compressed filter tow bale produced in the baling press has been wrapped, the baling press is usually opened such that the filter tow package is no longer subjected to any compressive stress.

Since the filter tow material has after the preceding compression process only a relatively small elastic or relaxing restoration component, the intensity of which particularly depends on the compression time and/or the compressive force, the filter tow package tends to expand after its release from the baling press, namely perpendicular to the filter tow material layers and opposite to the original compressive force exerted by the baling press.

The longer the compression time and the higher the compressive force during the compression of the filter tow bale in the filling can, the lower this elastic (relaxing) restoration component of the filter tow material. After the release from the baling press, only the relaxing restoration component represents the elastic restoring force that has to be absorbed by the packing material of the filter tow package in order to hold the bale together.

Conventional packaging materials are cardboard elements, which are mechanically held together by strappings or adhesive joints, or plastic fabrics, which are closed, for example, by means of a Velcro fastener.

An example of adhesive packaging is described in publication DE 76 35 849 U1. Information on filter tow packaging with plastic fabrics can be found in the company prospectus "Some Useful Information about the reusable Packaging for Rhodia Filter Tow": RHODIA Acetow GmbH, Engesserstrasse 8, D-79108 Freiburg.

The two latter packaging types are advantageous in that they do not require any additional strappings and the risk of constrictions and resulting tensile strength dispersions in the filter rods, which are ultimately produced of the filter tow material, is therefore minimized.

However, these two latter packaging types have the disadvantage that the relaxing restoration component acting after the release of the compressed bale, i.e. the elastic restoring force of the filter tow material, is absorbed by the packaging material. This inevitably leads to undesirable bulges on the upper side and the underside of the bale. Although these bulges do not interfere with the intended use of the filter tow material in the production of filter rods in a filter rod machine, they make it impossible to safely stack the thusly produced filter tow bales.

According to the prior art, this problem is either solved by laterally stacking the bales or by using special pallets of the type described in the aforementioned company prospectus of RHODIA Acetow GmbH.

It is furthermore known from publication WO 2003/089309 A2 to provide the filter tow material being compressed in a baling press with an airtight packaging sleeve, which completely encloses the filter tow bale, in the compressed state. When such a bale with an airtight enclosure is released from the baling press, the relaxing restoration component of the filter tow material causes a vacuum to be generated in the bale interior as the height of the highly compacted bale increases, wherein said vacuum at least partially equalizes the elastic restoring force of the filter tow material. In this way, undesirable bulges on the upper side and the underside of the bale can be at least reduced because the packaging material only has to absorb a smaller component of the elastic restoring force of the filter tow material.

In the latter packaging type, in which the filter tow material being compressed in the baling press is hermetically sealed with a packaging material such that the relaxing restoration component of the filter tow material is after the release of the filter tow bale from the baling press at least partially equalized by the vacuum being generated in the bale interior, it is problematic that there is a high risk of the bales bursting open after they are released from the baling press, particularly if the height of the filter tow bale can only increase slightly such that the vacuum generated in the bale interior is insufficient for adequately equalizing the elastic restoring force of the filter tow material effectively.

Among filter tow manufacturers, there is an increasing effort to package filter tow material with a method, which is "optimized" to the effect that the requirements of the filter or cigarette manufacturers with respect to the quality of the filter tow material being withdrawn from the filter tow bale are fulfilled and the risk of a "bale burst" is effectively minimized by the filter tow manufacturer.

In the packaging type known from publication WO 2003/089309 A2, different measures can basically be taken in order to reduce the failure rate during the production of packaged bales of highly compacted filter tow material, i.e. the risk of a bale burst after the release from the baling press.

The relaxing restoration component acting after the release of the bale from the baling press, i.e. the elastic restoring force of the filter tow material, may on the one hand be reduced by lowering the filling quantity of the bale accordingly. However, this measure has the disadvantage that the filter tow material of a bale is during its further processing, particularly in a filter rod machine, depleted relatively fast due to the reduced bale filling quantity such that a new filter tow bale has to be loaded into the filter rod machine. This leads to relatively frequent interruptions in the filter rod production and therefore is unacceptable for filter rod manufacturers.

Another measure for reducing the relaxing restoration component of the filter tow material after its release from the baling press would consist of increasing the compressive force exerted during the compression of the filter tow material in the baling press. However, this leads to quality defects in the compressed filter tow material and therefore to quality defects in the cigarette filters produced of the filter tow material. In addition, an increased compressive force would negatively affect the withdrawal of the filter tow material from the bale at the filter rod machine.

Another measure for reducing the relaxing restoration component of the filter tow material after its release from the baling press could consist of prolonging the compression time accordingly in order to increase the irreversible (i.e. non-elastic) restoration component of the filter tow material at the expense of the relaxing restoration component. However, a prolonged compression time inevitably reduces the press throughput and therefore is undesirable and unacceptable for filter tow manufacturers.

SUMMARY

The invention relates to a method for producing a packaged bale of highly compacted filter tow material. In particular, the invention relates to a method for producing a packaged bale of highly compacted filter tow material including the steps of producing a compressed filter tow bale of a cuboid shape in a baling press, and wrapping the compressed filter tow bale with an airtight packaging sleeve.

In light of these circumstances, the present invention is based on the objective of disclosing a method for producing a packaged bale of highly compacted filter tow material, in which the failure rate of the produced packaged bales is reduced and preferably lies below 1%, wherein the above-described disadvantages of the prior art are simultaneously eliminated.

The method should also be suitable for the production of a filter tow bale, in which the filling quantity of the bale does not fall short of a minimum quantity that is still acceptable for filter rod manufacturers, wherein the risk of quality defects in the filter tow material during the compression process is simultaneously minimized and the withdrawal of filter tow material from the bale at the filter rod machine is not impaired.

Furthermore, the method should also enable the filter tow material manufacturer to realize the conventional press throughput achieved so far.

According to the inventive method for producing a packaged bale of highly compacted filter tow material, a filter tow bale of cuboid shape is initially compressed in a baling press, wherein the compressed filter tow bale is subsequently wrapped with an airtight packaging sleeve, which completely encloses the compressed filter tow bale. During the packaging step, the packaging sleeve is applied to the compressed filter tow bale in such a way that at least 80%, preferably at least 90%, particularly at least 95%, of the packaging sleeve directly adjoins and therefore contacts the highly compacted filter tow material or is at least spaced apart from the highly compacted filter tow material by less than 15 mm.

The air volume enclosed outside the contour of the compressed filter tow bale during the packaging process can affect the expansion properties of the bale immediately after the compressive force ceases.

This comparatively simple measure surprisingly makes it possible to significantly reduce the risk of a thusly packaged compressed filter tow bale bursting open after its release from the baling press, namely in comparison with bales produced with the packaging type generally described, for example, in publication WO 2003/089309 A2. A failure rate of less than 1% particularly is realized for bales produced with the inventive method.

In this context, investigations have shown that the actual packaging process of the compressed filter tow bale is primarily responsible for the occurrence of a bale burst after the release of the packaged bale from the baling press. This is largely independent of the filling quantity of the bale, the compressive force exerted during the compression process and the compression time. Consequently, the inventive method can be implemented in a packaging process of the type generally described, for example, in publication WO 2003/089309 A2 without any problems.

Consequently, the risk of a bale burst after the release of the packaged filter tow bale from the baling press can be significantly reduced, namely despite a consistent filling quantity of the bale. The normally used compression process (compressive force and compression time) also does not have to be changed such that conventional baling presses and press sequences for the production of highly compacted bales of filter tow material can be used for carrying out the inventive method.

The inventive method not only reduces the failure rate, but also the risk of quality defects in the filter tow material during the compression process, wherein a desirable withdrawal of filter tow material from the bale for cigarette or filter manufacturers at the filter rod machine is at that same time not negatively affected.

Another significant advantage attained with the inventive production method can be seen in that the increase in height of the filter tow bale after its release from the baling press takes place in accordance with a predefined event sequence, wherein the maximum height change is also limited.

In this way, the maximum final height of the finished and packaged filter tow bale after its release from the baling press can be adjusted to a predefined maximum value beforehand.

Since interfering bulges on the upper side and the underside of the finished filter tow bale released from the baling press are prevented due to the use of an airtight packaging sleeve that completely encloses the filter tow bale, the bales produced in accordance with the inventive method can also be stacked without any problems. Since the inventive method also makes it possible to define the maximum height of the finished bale released from the baling press beforehand, it is possible to produce bales that can be stacked in double layers in standard containers such that the available space is optimally utilized.

In packaging methods known from the prior art, e.g. the packaging method described in publication WO 2003/089309 A2, it is impossible to realize this type of stackability in double layers such that the height of a standard container or the height of the door opening of a standard containers is not fully utilized.

The term "highly compacted filter tow material" used herein particularly refers to filter tow material with a packing density of at least 300 $kg/m^3$ and no more than 800 $kg/m^3$.

Conventional baling presses used in filter tow production are suitable for producing the compressed filter tow bale. This concerns baling presses with a compressive force of at least 100 $t/m^2$, but a maximum compressive force of 600 $t/m^2$ should not be exceeded. The compressed filter tow bale is preferably produced in the baling press by being compressed with a compressive force of at least 100 $t/m^2$ over a compression time of at least 4 to 20 min., preferably 5 to 15 min.

Different solutions may be considered in order to ensure that the packaging sleeve is during the packaging step of the inventive production method applied to the compressed filter tow bale in such a way that at least 80% of the packaging sleeve directly adjoins the filter tow material or is at least spaced apart from the filter tow material by less than 15 mm.

A measuring arrangement with at least one contactless sensor unit is particularly suitable for this purpose, wherein this sensor unit preferably features at least one distance sensor, particularly at least one 2D distance sensor array. The at least one distance sensor or the at least one 2D distance sensor array respectively makes it possible to exactly determine a distance between the highly compacted filter tow material on the one hand and the packaging material of the packaging sleeve on the other hand.

In this context, it would be conceivable, for example, that the distance between the at least one contactless distance sensor or the at least one contactless 2D distance sensor array and the filter tow material on the one hand and the distance between the at least one contactless distance sensor or the at least one contactless 2D distance sensor array and the packaging sleeve on the other hand may be determined with the measuring arrangement, wherein the actual distance between the packaging sleeve and the filter tow material can then be determined with consideration of the thickness of the packaging sleeve.

In this context, the contactless distance sensor or the contactless 2D distance sensor array may feature at least one light sensor, infrared radiation sensor, radio wave sensor, microwave sensor, T-ray sensor or ultrasonic sensor.

A distance measurement between the filter tow material and the packaging sleeve may be realized in the form of a transit time and phase position measurement with radio waves, light, infrared or ultrasound. The distance measurement may furthermore be realized by means of triangulation.

It would alternatively or additionally be conceivable to carry out a two-dimensional distance measurement. For example, the distance between the sensor device and the filter tow material can be determined with a 2D distance measuring method prior to packaging the compressed filter tow bale, wherein another 2D distance measurement is carried out after the application of the packaging sleeve, but this time with respect to the distance between the sensor device and the packaging sleeve. The actual distance between the applied packaging sleeve and the filter tow material can be determined without any problems by comparing the two recorded 2D distance measurements.

According to the present invention, it was particularly determined that the quantity of air enclosed between the packaging sleeve and the highly compacted filter tow material cannot exceed a maximum value if the risk of bale bursts after the release of the packaged filter tow bales from the baling press should be reduced. This is based on the realization that the quantity of air enclosed between the packaging sleeve and the highly compacted filter tow material is the decisive factor for an additional increase of the bale height when the wrapped, airtight filter tow bale is released from the baling press.

However, the increase in height during the release of the bale from the baling press cannot exceed a maximum value in order to effectively prevent that the packaging material has to absorb excessive forces resulting from the expansion of the filter tow material. This would not only negatively affect the flatness of the upper side and the underside of the finished bale, but the packaging material would also have to be designed for absorbing these forces.

If the majority of the expansive forces occurring during the expansion of the filter tow material after its release from the baling press is furthermore absorbed by the packaging material, the risk of a bale burst increases, particularly if the packaging sleeve is inadvertently damaged while the finished bale is handled.

Investigations have shown that the failure rate in the production of filter tow bales can be effectively reduced to less than 1% if the airtight packaging sleeve is applied around the compressed filter tow bale in such a way that no more than 50 liters of air, preferably no more than 30 liters of air, particularly no more than 10 liters of air, are enclosed between the packaging sleeve and the highly compacted filter tow material at a temperature of 20° C. when the compressed filter tow bale is wrapped with the airtight packaging sleeve, which completely encloses the compressed filter tow bale. If the latter volume of air is enclosed between the packaging sleeve and the highly compacted filter tow material, the failure rate in the production of filter tow bales can even be effectively reduced to less than 0.2%.

The air quantity enclosed between the packaging sleeve and the highly compacted filter tow material during the wrapping of the compressed filter tow bale can be determined indirectly with a distance measurement between the packaging sleeve and the highly compacted filter tow material. The above-described optical measuring methods particularly may be considered for this distance measurement.

In a preferred realization of the inventive method, the filter tow bale being compressed in the baling press is realized in such a way that it has a cuboid shape with a preferably rectangular base, which is adapted to the dimensions of a transport pallet, particularly a Europool pallet, and measures at least 6,500 $cm^2$, preferably at least 6,500 $cm^2$, and a height of at least 75 cm, preferably at least 85 cm. In this case, the filter tow bale being compressed in the baling press should be produced in such a way that it has a bale density of at least 300 $kg/m^3$.

Several synergistic effects can be achieved if the packaging sleeve is during the subsequent packaging step applied to the compressed filter tow bale in such a way that no more than 650 liters of air, preferably no more than 450 liters of air, particularly no more than 400 liters of air, are altogether contained in the volume enclosed by the packaging sleeve at a temperature of 20° C.:

On the one hand, it is ensured that bale bursts after the release of the thusly produced bales from the baling press are virtually precluded (failure rate considerably less than 0.5%).

On the other hand, interfering bulges on the upper side and the underside of the bale being released from the baling press are effectively prevented such that the stackability of the bales is ensured.

However, this enhancement of the inventive method particularly makes it possible to produce highly compacted filter tow bales, in which the conventional compressive forces and compression times used in the packaging of filter tow material can even be reduced.

The material of the packaging sleeve may particularly consist of a plastic film. The film is preferably made of polyethylene, particularly LDPE, or of modified polyethylene (LLDPE) or of a composite film with a polyamide layer and a polyethylene layer.

A colored or printed film may also be used as packaging film, particularly for advertising and/or aesthetic purposes. This is also sensible, in particular, if the filter tow material to be packaged is sensitive to light.

The packaging film preferably has a thickness between 100 and 400 μm such that it can simultaneously serve as transport packaging. As already mentioned above, bales produced in accordance with the inventive method do not require the addition of another transport packaging consisting of cardboard elements, plastic fabric, etc., around the packaging film of the bale.

It is likewise not required to provide an additional or alternative strapping on the finished bale because the risk of the bale bursting open is virtually eliminated due to the special packaging step proposed by the present invention.

The compressed filter tow bale of cuboid shape is generally produced with the aid of a baling press known from the prior art. The inventive method may be carried out in such a way that the quantity of filter tow material to be packaged initially is mechanically compressed and then wrapped with the packaging sleeve, wherein the packaging sleeve preferably is hermetically sealed within the baling press such that the entire production process can be carried out in one location.

However, it is naturally also possible to carry out a preparatory compression of the filter tow material in a separate station. In this case, the compressed filter tow bale is fed to a packaging station in an "auxiliary packaging" that may consist, e.g., of holding clamps, wherein the auxiliary packaging is removed and the compressed filter tow bale is wrapped with the airtight packaging film in said packaging station. This embodiment would have the advantage that not the entire process is carried out in the baling press such that the baling press would have greater availability. In addition, the press cycle is shortened and several degrees of freedom with respect to the application of the packaging sleeve are realized because the compressed bale is accessible from all sides in the packaging station.

According to another aspect of the inventive packaging method, it is particularly proposed that the compressed filter tow bale is during the packaging step wrapped with the packaging sleeve in such a way that the volume enclosed by the packaging sleeve can increase by at least 32 liters, preferably by at least 70 liters, after the release of the packaged filter tow bale from the baling press without thereby extending or stretching the material of the packaging sleeve.

In this way, a "growth reserve" is deliberately provided in the packaging material surrounding the compressed bale during the packaging process of the compressed filter tow material. This growth reserve in the packaging material can be realized, for example, in that the packaging material is in certain areas deliberately provided with a folded region, which unfolds when the packaged bale is released and thereby allows the bale height to predictably increase up to a final height of the bale that is predefined by the folded region.

The growth reserve realized with the folded region is preferably chosen in such a way that the volume enclosed by the airtight packaging sleeve can increase during the expansion of the filter tow material after its release from the baling press until the vacuum in the bale interior being generated thereby is sufficiently high in relation to the outside atmosphere for equalizing the restoring forces of the filter tow material to the greatest extent possible, wherein the material of the packaging sleeve is neither extended nor stretched during this process and the packaging material only has to absorb negligible forces or no forces at all.

In a particularly preferred realization of the inventive method, it is proposed that the cuboid filter tow bale being compressed in the baling press is produced between a cover film section and a bottom film section prior to wrapping the compressed filter tow bale with the airtight packaging sleeve, wherein the airtight packaging sleeve, which completely encloses the compressed filter tow bale, is produced in the subsequent packaging step by bonding or welding together the two film sections.

In this context, it would particularly be conceivable to apply a sleeve film section to the lateral surfaces of the compressed filter tow bale in the packaging step. Subsequently, the opposite end regions of the sleeve film section are brought together on the face and connected to one another. In addition, the surface area of the sleeve film section is connected to the bottom film section and the cover film section in such a way that an altogether airtight packaging sleeve, which completely encloses the compressed filter tow bale, is ultimately formed.

In this case, it is particularly preferred to apply the sleeve film section to the lateral surfaces of the compressed filter tow bale in such a way that at least 80%, preferably at least 90%, particularly at least 95%, of the surface area of the sleeve film section directly adjoins and therefore contacts the highly compacted filter tow material or is at least spaced apart from the highly compacted filter tow material by less than 15 mm.

In this context, the term "surface area of the sleeve film section" refers to the covering area of the sleeve film section, which points in the direction of and contacts the filter tow material in the finished state of the filter tow bale after its release from the baling press. The term "contacts the filter tow material" refers to at least 80%, preferably at least 90%, particularly at least 95%, of the packaging sleeve directly adjoining and therefore contacting the highly compacted filter tow material or being at least spaced apart from the highly compacted filter tow material by less than 15 mm.

In this embodiment of the inventive method, it is particularly advantageous if the sleeve film section is realized in the form of a flat film.

As a matter of principle, the packaging sleeve should have a maximum gas permeability of 10,000 $cm^3/(m^2 \times d \times bar)$, preferably no more than approximately 200 $cm^3/(m^2 \times d \times bar)$, particularly no more than approximately 20 $cm^3/(m^2 \times d \times bar)$, namely in respective measurements according to DIN 2000-07 (status: application date) carried out at 23° C. and 75% relative humidity of air.

The material of the packaging sleeve should have a tear strength of at least 10 N/15 mm, preferably at least 100 N/15 mm, particularly at least 200 N/15 mm, namely in respective measurements according to DIN EN ISO 527-1 "General Principles for the Determination of Tensile Properties of Plastics" or measurements according to DIN EN ISO 527-3 "Test Conditions for Films and Sheets" (respective status: application date).

In this context, it should be noted that the aforementioned requirements with respect to the tear strength of the material of the packaging sleeve are only necessary because the material serving as packaging sleeve is preferably applied with prestressing force when the compressed filter tow bale is wrapped with an airtight packaging sleeve, which completely encloses the compressed filter tow bale, wherein the packaging sleeve can thereby be applied to the compressed filter tow bale in such a way that at least 80%, preferably at least 90%, particularly at least 95%, of the packaging sleeve directly adjoins and therefore contacts the highly compacted filter tow material or is at least spaced apart from the highly compacted filter tow material by less than 15 mm.

The extensibility of the material serving as packaging sleeve should amount to no more than 1000 mm/15 mm in measurements according to DIN EN ISO 527 (see above). The yield strength at 10% extension in the longitudinal direction should amount to no more than 38 to 47 N/15 mm in measurements according to DIN EN ISO 527 (see above).

Since the packaging sleeve preferably also represents the transport packaging of the filter tow bale, it is in this context particularly advantageous if the specific puncture resistance of the packaging sleeve material amounts to at least 8 N—referred to the 0.8 mm arbor according to DIN EN 14477 (Edition 2004-06).

The aforementioned maximum gas permeability of the material serving as packaging sleeve, if applicable in combination with the cited minimum puncture resistance, ensures that a vacuum in relation to the outside atmosphere, which is generated in the bale interior after the release from the baling press (due to the self-expansion of the filter tow material), can be maintained sufficiently long.

In this context, "sufficiently long" means at least 24 hours and preferably until the package bale is deliberately opened at a filter rod machine in order to further process the packaged bale material.

However, it was determined that it is also harmless if the packaging sleeve of the bale is inadvertently perforated, for example, during the transport of the filter tow material to a filter rod machine for further processing. However, it is advantageous that the air tightness of the packaging sleeve is largely ensured until the bale is deliberately opened at a filter rod machine.

When using a sleeve film section that fulfils these requirements, particularly with respect to the tear strength and the extensibility, it is advantageous to apply prestressing force to the sleeve film section after its application to the lateral surfaces of the compressed filter tow bale.

This is preferably realized with an average prestressing force of at least 50 N, particularly at least 75 N. In this way, it can be easily yet effectively ensured that no more than 20% of the sleeve film section does not directly adjoin the filter tow material in the packaging step between the packaging sleeve (particularly the sleeve film section) and the compressed filter tow material.

Examples of different options for realizing the inventive method are described below with reference to the attached drawings.

DETAILED DESCRIPTION

Figure 1A:
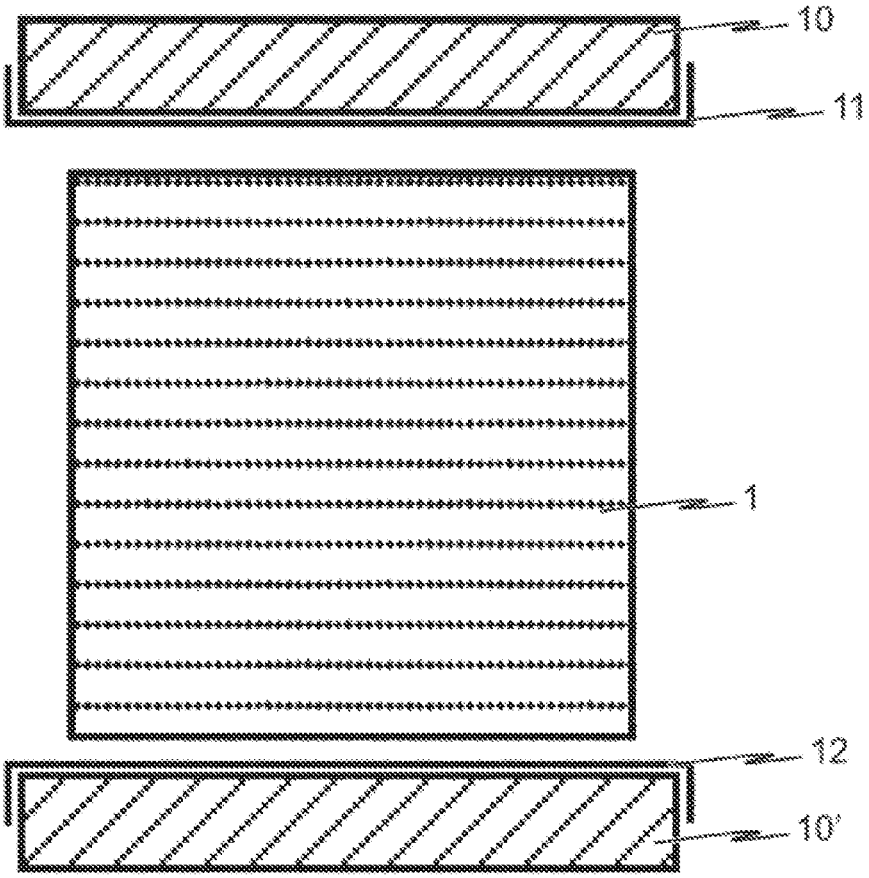
FIG. 1*a* schematically shows the filter tow material to be packaged in the baling press or filling can prior to the compression process in an exemplary embodiment of the inventive method for producing a packaged bale of highly compacted filter tow material.

In the exemplary embodiment of the inventive method, filter tow material 1 is placed into a baling press as schematically indicated in FIG. 1*a*. The filter tow material 1 is compressed to the desired packing dimension (see FIG. 1*b*) in the baling press, which has a compressive force, for example, of 300 to 400 t.

The compression process is preferably carried out in such a way that the filter tow bale being compressed in the baling press has a packing density of at least 250 kg/m$^2$, particularly a packing density of at least 300 kg/m$^2$. It is furthermore preferred to carry out the compression process in such a way that the filter tow bale being compressed in the baling press has a packing density of no more than 700 kg/m$^2$, particularly a packing density of no more than 600 kg/m$^2$.

The packing dimension, i.e. the height of the filter tow bale being compressed in the baling press, preferably amounts to at least 700 mm. As initially mentioned, the production of the compressed filter tow bale in the baling press causes the filter tow material 1 to be compressed in such a way that the elastic restoration properties of the filter tow material are reduced.

Figure 1B:
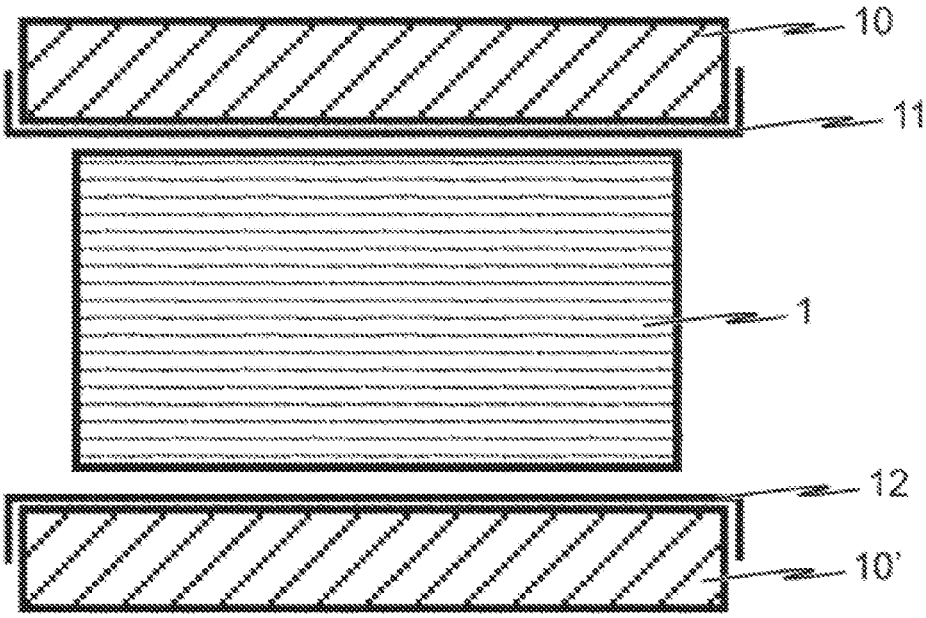
FIG. 1*b* schematically shows the filter tow material to be packaged after the compression in the baling press or filling can, namely in the exemplary embodiment of the inventive method according to FIG. 1*a;*

In the embodiment schematically illustrated in FIG. 1*a* and FIG. 1*b*, the press ram 10, 10' of the baling press is prepared accordingly prior to placing the filter tow material into the baling press or prior to placing the filter tow material into the filling can of the baling press. In the embodiment schematically illustrated in the drawings, it is specifically proposed that the compression of the filter tow material in the baling press takes place between a cover film section 11 and a bottom film section 12.

In the embodiment schematically illustrated in the drawings, it is proposed that the bottom of the filling can is for this purpose garnished with a bottom film section 12 prior to compressing the filter tow material and prior to placing the filter tow material into the filling can. The filter tow material 1 to be compressed is subsequently placed into the thusly prepared filling can.

Prior to pushing the content of the full filling can including the filling can bottom on the baling press into the press chamber, the upper press ram 10 of the baling press is likewise garnished with a film section (cover film section 11).

Due to the inclusion of the cover and bottom film sections 11, 12, the subsequent bottom and cover films already are correctly positioned (above and underneath the bale) prior to the compression of the filter tow material.

The thusly prepared filter tow material 1 is then compressed into a filter tow bale in the baling press (see FIG. 1*b*). The actual compression process corresponds to conventional compression processes known from the prior art and is not part of the invention disclosed herein.

As a matter of principle, it is advantageous if the compression of the filter tow material in the baling press takes place in accordance with a predefined program sequence such that the relaxing restoration component in the compressed filter tow bale is likewise reduced in accordance with a predefined or predefinable event sequence. In this context, it is advantageous if the compression process continues for at least 4 minutes, preferably at least 5 minutes, in order to sufficiently reduce the relaxing restoration component in the filter tow material.

Consequently, a compressed filter tow bale of cuboid shape is produced in the baling press between the cover film section 11 and the bottom film section 12 as schematically illustrated in FIG. 1*b*. In the subsequent step, the compressed filter tow bale is wrapped with an airtight packaging sleeve, which completely encloses the compressed filter tow bale.

Figure 1C:
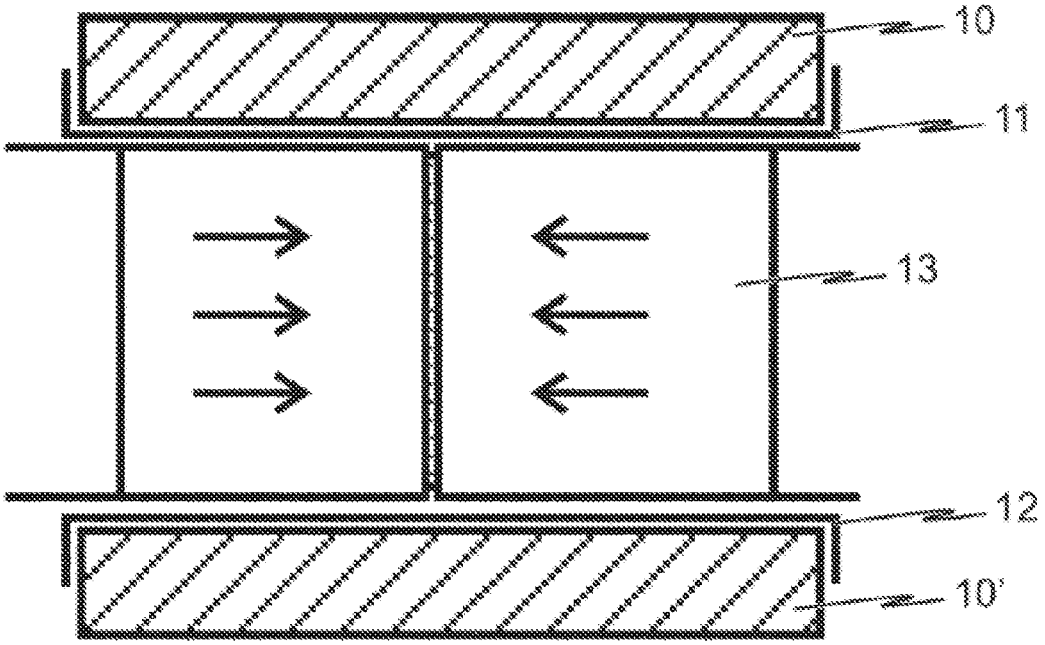
FIG. 1*c* schematically shows the application of a sleeve film section to the lateral surfaces of the compressed filter tow bale according to FIG. 1*b*.

According to the schematic illustration in FIG. 1*c*, a sleeve film section 13 is for this purpose applied to the lateral surfaces of the compressed filter tow bale in the exemplary embodiment of the inventive method, wherein the sleeve film section 13 has a surface area with two opposite end regions. Subsequently, the opposite end regions of the sleeve film section 13 are brought together on the face and connected to one another.

Figure 1D:
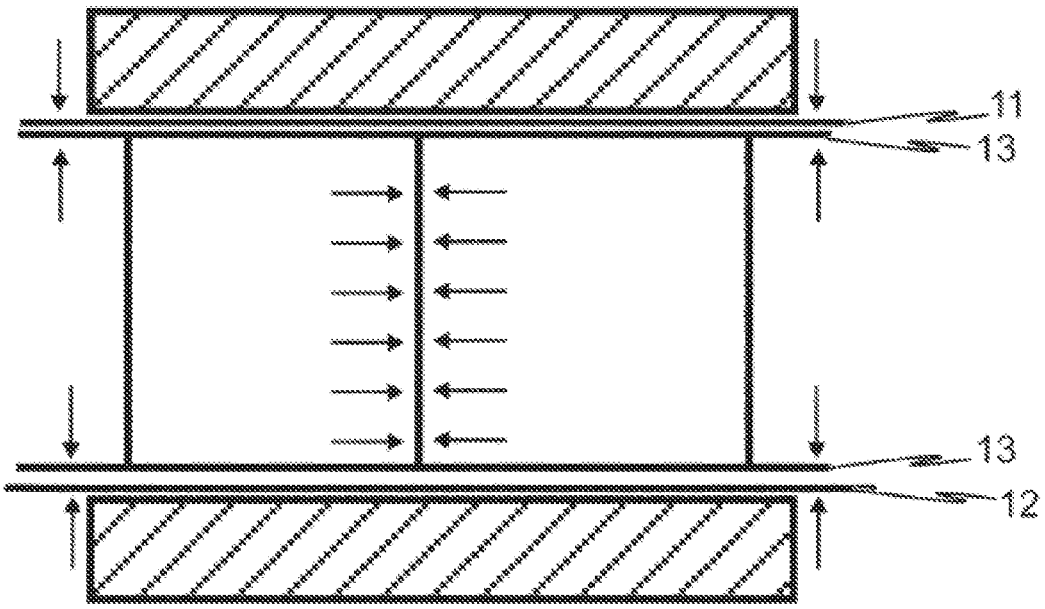
FIG. 1*d* schematically shows the connection of the surface area of the sleeve film section to the bottom film section and the cover film section in the exemplary packaging method illustrated in the drawings.

Furthermore, the surface area of the sleeve film section 13 is connected to the bottom film section 12 and the cover film section 11—as schematically illustrated in FIG. 1*d*. The connection of the end regions of the sleeve film section 13 to one another and the connection of the surface area of the sleeve film section 13 to the bottom film section 12 and the cover film section 11 are produced in such a way that an altogether airtight packaging sleeve, which completely encloses the compressed filter tow bale, is ultimately formed.

In the inventive method schematically illustrated in the drawings, the sleeve film section 13 is applied to the lateral surfaces of the compressed filter tow bale in such a way that at least 80%, preferably at least 90%, particularly at least 95%, of the surface area of the sleeve film section 13 directly adjoins and therefore contacts the highly compacted filter tow material or is at least spaced apart from the highly compacted filter tow material by less than 15 mm.

In order to reduce the risk of a bale burst, it is particularly advantageous if the compressed filter tow bale being produced in the baling press has a cuboid shape with a preferably rectangular base, which is adapted to the dimensions of a transport pallet, particularly a Europool pallet, and measures at least 6,500 $cm^2$, preferably at least 8,500 $cm^2$, and a height (packing dimension) of at least 75 cm, preferably at least 85 cm. In the exemplary embodiment, a compressed filter tow bale with these dimensions produced in the baling press has a bale density of at least 300 $kg/m^3$.

The term "dimensions of a transport pallet" used herein particularly refers to the dimensions of a commonly used transport pallet. This particularly concerns a transport pallet that is adapted to standard container dimensions such as a Europool pallet.

Europool pallets are based on a basic module with a size of 400 mm×600 mm. Pallets of this size are also referred to as "¼ Europool pallets" and correspond to the size of a so-called VDA box. The wooden Europool pallets EUR, which have been commonly used for many years, measure 800×1200×144 mm. These half Europool pallets with a size of 800 mm×600 mm are also referred to as display pellets. At EPAL, they are called "EUR 6-pallets;" they are also referred to as Dusseldorf pallets.

So-called industrial pallets (1000×1200×144 mm) are slightly larger and also widely used, wherein these industrial pallets are respectively standardized as "EUR 3-pallets" or in reinforced form as "EUR 2-pallets" by EPAL.

Large non-standardized pallets frequently have twice the industrial size, i.e. they measure 2000×1200 mm or 2000×1250 mm.

The pallets commonly used on the American continent and partially also in China have a size of 48×40 inches, i.e. they measure 1219.2 mm×1016 mm and therefore approximately correspond to industrial pallets (1,200 mm×1,000 mm), whereas pallets with a size of 1,100 mm×1,100 mm or 1,140 mm×1,140 mm are generally used in Asia.

In this exemplary embodiment, the sleeve film section 13 is applied to the lateral surfaces of the compressed filter tow bale in such a way that no more than 650 liters of air, preferably no more than 450 liters of air, particularly no more than 400 liters of air, are altogether contained in the volume enclosed by the sleeve film section 13, the cover film section 11 and the bottom film section 12 at a temperature of 20° C.

As already mentioned in the general portion of the description, the risk of a bale burst after the release of the hermetically enclosed bale from the baling press is thereby effectively reduced to considerably less than 1%.

In the exemplary embodiment schematically illustrated in the drawings, in which the baling press is garnished with a bottom film section 12 and a cover film section 11 prior to the compression of the filter tow material and a sleeve film section 13 is subsequently applied to the lateral surfaces of the compressed bale, it is advantageous if the sleeve film section is applied to the lateral surfaces of the compressed filter tow bale in such a way that no more than 50 liters of air, preferably no more than 30 liters of air, particularly no more than 10 liters of air, are enclosed between the surface area of the sleeve film section and the highly compacted filter tow material at a temperature of 20° C.

This can be achieved, for example, in that the sleeve film section 13 is applied to the lateral surfaces of the compressed filter tow bale with an average application prestressing force of at least 50 N, preferably at least 75 N. This application prestressing force can be easily controlled and monitored with strain gauges or similar sensors.

In order to form an airtight packaging sleeve in the embodiment schematically illustrated in the drawings, it is proposed to produce a vertically extending weld seam, particularly a finned seam, in a vertical overlapping region formed when the opposite end regions of the sleeve film section 13 are brought together on the face.

Subsequently, the sleeve film section is prestressed in the direction of the vertically extending weld seam and fixed, temporarily, with the aid of clamps or similar fixing means. In an exemplary embodiment, it is proposed to subsequently produce a peripheral horizontal overlapping region between the upper end region of the sleeve film section 13 and a peripheral edge region of the cover film section 11. A peripheral horizontal overlapping region between the lower end region of the sleeve film section 13 and a peripheral edge region of the bottom film section 12 is produced analogously. A peripheral weld seam, particularly a finned seam, is then respectively produced in the peripheral horizontal overlapping regions.

In this case, the vertically extending weld seam and the peripheral weld seams in the peripheral horizontal overlapping regions are produced in such a way that the bottom film section 12, the cover film section 11 and the sleeve film section 13 altogether form an airtight packaging sleeve, which completely encloses the compressed filter tow bale.

In order to produce the peripheral horizontal overlapping regions, it is advantageous if the respective edge regions of the cover film section 11 and the bottom film section 12 are drawn outward and away from the bale.

According to an exemplary embodiment, the sleeve film section 13 is applied to the lateral surfaces of the filter tow bale in such a way that the vertical overlapping region preferably is arranged centrally between two vertically extending corner edges of the filter tow bale. In order to prestress the sleeve film section 13 in the direction of the vertical weld seam, the film material of the sleeve film section 13 can then preferably be displaced manually in the direction of the vertical weld seam such that the overlapping region is enlarged in the horizontal direction. In this context, it is advantageous if the sleeve film section 13 is prestressed with an average prestressing force of at least 50 N, particularly at least 75 N. This prestressing force can be easily monitored, for example, with correspondingly arranged strain gauges.

When producing the peripheral weld seam in the peripheral horizontal overlapping regions in accordance with the inventive method, it is advantageous to produce the peripheral weld seam in the respective peripheral horizontal overlapping region at a predefined or predefinable minimum distance from the bale. This predefined or predefinable minimum distance lies in the range between 2 and 20 cm, preferably in the range between 5 and 10 cm. This distance between the bale and the weld seam ultimately represents the dimension, by which the finished bale can expand without exerting stress upon the packaging sections when the bale is released from the baling press.

In general terms, the predefined or predefinable minimum distance between the peripheral weld seam and the bale should therefore be chosen in dependence on the elastic restoration properties of the compressed filter tow material after its release from the baling press.

The compressed filter tow bale is released from the baling press after it has been hermetically packaged. This can be realized by incrementally increasing the distance between the upper and lower press plates of the baling press in order to allow an incremental expansion of the filter tow material. Stress peaks can be thereby prevented.

In this context, it is advantageous if the distance between the upper and lower press plates is in a first step increased by 10 to 35 mm, preferably by 15 to 30 mm, particularly by 20 to 25 mm. The distance between the upper and the lower press plate is then increased to at least 1,200 mm in a second step, which is carried out with a certain time delay after the first step.

The characteristics of the packaging method schematically illustrated in the drawings can be briefly summarized as follows:

Step i): producing a compressed filter tow bale of cuboid shape in a baling press.

Step ii): wrapping the compressed filter tow bale with an airtight packaging sleeve, which completely encloses the compressed filter tow bale.

Step iii): releasing the filter tow bale, which is completely enclosed by the airtight packaging sleeve, from the baling press.

According to the invention, it is proposed that the packaging sleeve is in step ii) applied to the compressed filter tow bale in such a way that at least 80%, preferably at least 90%, particularly at least 95%, of the packaging sleeve directly adjoins and therefore contacts the highly compacted filter tow material or is at least spaced apart from the highly compacted filter tow material by less than 15 mm.

In this context, it is particularly advantageous if the packaging sleeve is in step ii) applied around the compressed filter tow bale in such a way that no more than 50 liters of air, preferably no more than 30 liters of air, particularly no more than 10 liters of air, are enclosed between the surface area of the sleeve film section 13 and the highly compacted filter tow material at a temperature of 20° C.

In preferred realizations of the inventive packaging method, the filter tow bale being compressed in the baling press has in step i) a cuboid shape with a preferably rectangular base, which measures at least 6,500 $cm^2$, preferably at least 8,500 $cm^2$, and a height of at least 75 cm, preferably at least 85 cm, wherein the filter tow bale particularly is produced in step i) in such a way that the filter tow bale being compressed in the baling press has a bale density of at least 300 $kg/m^3$.

In this context, it is advantageous if the packaging sleeve is then in step ii) applied to the compressed filter tow bale in such a way that no more than 650 liters of air, preferably no more than 450 liters of air, particularly no more than 400 liters of air, are altogether contained in the volume enclosed by the packaging sleeve at a temperature of 20° C.

It would alternatively or additionally also be conceivable that the filter tow bale of cuboid shape being compressed in the baling press is in step i) produced between a cover film section 11 and a bottom film section 12, wherein the airtight packaging sleeve, which completely encloses the compressed filter tow bale, is subsequently produced in step ii) by bonding or welding together the two film sections.

According to an aspect of the invention, which is also incorporated into the packaging method schematically illustrated in the drawings, it is proposed that the filter tow bale of cuboid shape being compressed in the baling press is in step i) produced between a cover film section 11 and a bottom film section 12. With respect to the following step ii), it is proposed that this step comprises the following procedures:

a) applying a sleeve film section 13 to the lateral surfaces of the compressed filter tow bale, wherein the sleeve film section 13 has a surface area with two opposite end regions;

b) bringing together the opposite end regions of the sleeve film section 13 on the face; and c) connecting the opposite end regions of the sleeve film section 13 to one another and connecting the surface area of the sleeve film section 13 to the bottom film section 12 and the cover film section 11 in such a way that an altogether airtight packaging sleeve, which completely encloses the compressed filter tow bale, is ultimately produced.

According to an enhancement of this exemplary embodiment of the inventive packaging method, it is proposed that the filter tow bale being compressed in the baling press has in step i) a cuboid shape with a preferably rectangular base, which measures at least 6,500 $cm^2$, preferably at least 8,500 $cm^2$, and a height of at least 75 cm, preferably at least 85 cm, wherein the filter tow bale is in step i) produced in such a way that the filter tow bale being compressed in the baling press has a bale density of at least 300 $kg/m^3$.

In this context, it is proposed that the sleeve film section 13 is in step a) applied to the lateral surfaces of the compressed filter tow bale in such a way that no more than 650 liters of air, preferably no more than 450 liters of air, particularly no more than 400 liters of air, are altogether contained in the volume enclosed by the sleeve film section 13, the cover film section 11 and the bottom film section 12 at a temperature of 20° C.

It would alternatively or additionally also be conceivable that the sleeve film section 13 is in step a) applied to the lateral surfaces of the compressed filter tow bale in such a way that no more than 50 liters of air, preferably no more than 30 liters of air, particularly no more than 10 liters of air, are enclosed between the surface area of the sleeve film section 13 and the highly compacted filter tow material at a temperature of 20° C.

For this purpose, it is particularly proposed that the sleeve film section 13 is in step a) applied around the lateral surfaces of the compressed filter tow bale with an average application prestress of at least 50 N, particularly at least 75 N.

According to an enhancement of the latter embodiments, it is proposed that step ii) furthermore comprises the following procedures:

d) producing a vertically extending weld seam, particularly a finned seam, in a vertical overlapping region formed when the opposite end regions of the sleeve film section 13 are brought together on the face;

e) prestressing the sleeve film section 13 in the direction of the vertically extending weld seam and fixing, in particular temporarily, the sleeve film section 13 in its prestressed state;

f) producing a peripheral horizontal overlapping region between the upper end region of the sleeve film section 13 and a peripheral edge region of the cover film section 11 and producing a peripheral horizontal overlapping region between the lower end region of the sleeve film section 13 and a peripheral edge region of the bottom film section 12; and g) respectively producing a peripheral weld seam, particularly a finned seam, in the peripheral horizontal overlapping regions.

In this context, it is particularly proposed that the vertically extending weld seam and the peripheral weld seams in the peripheral horizontal overlapping regions are produced in such a way that the bottom film section 12, the cover film section 11 and the sleeve film section 13 form an airtight packaging sleeve, which completely encloses the compressed filter tow bale.

The respective edge regions of the cover film section 11 and the bottom film section 12 are preferably drawn outward and away from the bale in order to produce the peripheral horizontal overlapping regions in step f). On the other hand, it is also advantageous if the sleeve film section 13 is in step e) prestressed with an average prestressing force of at least 50 N, particularly at least 75 N.

In a preferred realization of the latter embodiments, it is proposed that the sleeve film section 13 is in step a) applied to the lateral surfaces of the filter tow bale in such a way that the vertical overlapping region preferably is arranged centrally between two vertically extending corner edges of the filter tow bale, wherein the film material of the sleeve film section 13 is then preferably displaced manually in the direction of the vertical weld seam such that the overlapping region is enlarged in the horizontal direction in order to prestress the sleeve film section 13 in the direction of the vertical weld seam.

As a matter of principle, it is advantageous if the peripheral weld seam is in step g) produced in the peripheral horizontal overlapping regions at a predefined or predefinable minimum distance from the bale. The predefined or predefinable minimum distance should lie in the range between 2 and 20 cm, preferably in the range between 5 and 10 cm. This predefined or predefinable minimum distance between the peripheral weld seam and the bale should particularly be chosen in dependence on the elastic restoration properties of the compressed filter tow material after its release from the baling press.

According to a preferred realization of the latter embodiments, it is proposed that the sleeve film section 13 is in step e) fixed, in particular temporarily, in its prestressed state, namely by laterally folding over the vertical overlapping region and fixing the folded overlapping region on the bale, preferably with an adhesive tape or a similar detachable fixing means.

It is alternatively or additionally also advantageous if the sleeve film section 13 is in step a) applied to the lateral surfaces of the filter tow bale with a certain prestress in the horizontal direction. In this context, it would particularly be conceivable that the sleeve film section 13 is in step a) positioned relative to the cover film section 11 and the bottom film section 12 and temporarily fixed in the positioned state. The upper and/or lower edge region of the sleeve film section 13 is preferably held on the baling press by a restraint in order to position and temporarily fix the sleeve film section 13.

In this context, it is particularly advantageous if the baling press features an upper and a lower press plate, between which the compressed filter tow bale is produced in step i), wherein the upper edge region of the sleeve film section 13 is held, particularly clamped, by a restraint arranged on the upper press plate of the baling press in order to position and temporarily fix the sleeve film section 13. In this case, the temporarily fixed sleeve film section 13 should be released, in particular, directly before the peripheral horizontal overlapping regions are produced in step f).

According to an aspect of the present invention, step i) comprises the following procedures:

- preparing a filling can by garnishing the bottom of the filling can with the bottom film section 12;
- preparing a press ram 10 of the baling press by a garnishing the press ram 10 with the cover film section 11;
- placing the filter tow material to be packaged into the prepared filling can; and
- compressing the filter tow material placed into the prepared filling can by moving the prepared press ram 10 into the filling can from above.

It would alternatively be conceivable that step i) comprises the following procedures:

- preparing a stationary press yoke by garnishing the press yoke with the cover film section 11;
- preparing a press ram 10' of the baling press by garnishing the press ram 10' with the bottom film section 12;
- arranging the filter tow material to be packaged between the prepared press yoke and the press ram 10'; and
- compressing the filter tow material by displacing the prepared press ram 10' in the direction of the press yoke from below.

With respect to step iii), it is particularly proposed that the baling press features an upper and a lower press plate, wherein the filter tow bale is released from the baling press by incrementally increasing the distance between the upper and the lower press plate. In this context, it is particularly proposed that the distance between the upper and the lower press plate is in a first step increased by 10 to 35 mm, preferably by 15 to 30 mm, particularly by 20 to 25 mm. The distance between the upper and the lower press plate is then increased to at least 1.200 mm in a second step, which is carried out with a certain time delay after the first step.

It is particularly advantageous to compress the filter tow bale in the baling press for at least 180 s, particularly for at least 250 s, such that a bale density of at least 300 kg/m$^3$ is achieved prior to releasing the filter tow bale, which is completely enclosed by the airtight packaging sleeve in step ii). This ensures that the elastic restoration properties of the filter tow material are sufficiently reduced. The invention is not limited to the exemplary embodiment of the inventive packaging method illustrated in the drawings, but rather results from a synopsis of all characteristics disclosed herein.

The invention particularly also pertains to a filter tow bale of cuboid shape, which is produced in accordance with the inventive method and has a packing density of at least 250 kg/m$^3$.

The present application has priority in case the content of any patents, patent applications and publications, to which this application refers, conflicts with the content of the present application to the effect that the conflict obscures a definition of the present application.

The invention claimed is:

1. A method for producing a packaged filter tow bale, wherein the method comprises the following steps:

i) producing a compressed filter tow bale in a baling press; and ii) wrapping the compressed filter tow bale with an airtight packaging sleeve, which completely encloses the compressed filter tow bale, wherein step ii) further includes applying the airtight packaging sleeve to the compressed filter tow bale in such a way that at least 80% of the airtight packaging sleeve does at least one of: (1) directly adjoins and therefore contacts the compressed filter tow bale; and (2) is spaced apart from the compressed filter tow bale by less than 15 mm, wherein step ii) further includes wrapping the compressed filter tow bale with the airtight packaging sleeve in such a way that a volume enclosed by the airtight packaging sleeve can increase by at least 32 liters after the packaged filter tow bale is released from the baling press without thereby extending or stretching the airtight packaging sleeve.

2. The method according to claim 1, wherein step ii) further includes applying the airtight packaging sleeve around the compressed filter tow bale in such a way that no more than 50 liters of air are enclosed between the airtight packaging sleeve and the compressed filter tow bale at a temperature of 20° C.

3. The method according to claim 1, wherein step i) further includes producing the compressed filter tow bale with a base adapted to the dimensions of a transport pallet and measuring at least 6,500 $cm^2$; and producing the compressed filter tow bale with a height of at least 75 cm and a bale density of at least 300 $kg/m^3$; and step ii) further includes applying the airtight packaging sleeve to the compressed filter tow bale in such a way that no more than 650 liters of air are contained in a volume enclosed by the airtight packaging sleeve at a temperature of 20° C.

4. The method according to claim 1, wherein step i) further includes producing the compressed filter tow bale between at least one cover film section and one bottom film section, and wherein step ii) further includes producing the airtight packaging sleeve by at least one of: (1) bonding together the at least one cover film section and the one bottom film section; and (2) welding together the at least one cover film section and one bottom film section.

5. The method according to claim 1, wherein step i) further includes the following steps:

i.a) preparing a filling can by placing a bottom film section at a bottom of the filling can;

i.b) preparing a press ram of the baling press by placing a cover film section on the press ram;

i.c) placing a filter tow material into the prepared filling can; and i.d) compressing the filter tow material in the baling press.

6. The method according to claim 5, wherein at least one of (1) the cover film section and (2) the bottom film section is in the form of a flat film.

7. The method according to claim 6, wherein the cover film section and the bottom fil section are flat films with edge lengths, wherein each edge length of each of the cover film section and the bottom film section is longer than each corresponding peripheral horizontal edge length of the compressed filter tow bale by at least 10 cm.

8. The method according to claim 1, wherein the airtight packaging sleeve features at least one film section of a plastic material.

9. The method according to claim 1, wherein the packaged filter tow bale includes a packing density of at least 250 $kg/m^3$.

10. The method according to claim 1, wherein step ii) further includes applying the airtight packaging sleeve around the compressed filter tow bale in such a way that no more than 10 liters of air are enclosed between the airtight packaging sleeve and the compressed filter tow bale at a temperature of 20° C.

11. The method according to claim 1, wherein step ii) further includes applying the airtight packaging sleeve to the compressed filter tow bale in such a way that at least 95% of the airtight packaging sleeve does at least one of: (1) directly adjoins and therefore contacts the compressed filter tow bale; and (2) is spaced apart from the compressed filter tow bale by less than 15 mm.

12. The method according to claim 1, wherein step i) further includes the following steps:

i.e) preparing a stationary press yoke by placing a cover film section on the stationary press yoke;

i.f) preparing a press ram of the baling press by placing a bottom film section on the press ram;

i.g) arranging a filter tow material between the stationary press yoke and the stationary press ram; and i.h) compressing the filter tow material by displacing the press ram in the direction of the stationary press yoke.

13. A method for producing a packaged filter tow bale, wherein the method comprises the following steps:

i) producing a compressed filter tow bale in a baling press, the compressed filter tow bale having lateral surfaces; and ii) wrapping the compressed filter tow bale with an airtight packaging sleeve, which completely encloses the compressed filter tow bale, wherein step ii) further includes applying the airtight packaging sleeve to the compressed filter tow bale in such a way that at least 80% of the airtight packaging sleeve does at least one of: (1) directly adjoins and therefore contacts the compressed filter tow bale; and (2) is spaced apart from the compressed filter tow bale by less than 15 mm, wherein step i) further includes producing the compressed filter tow bale between a cover film section and a bottom film section, and wherein step ii) further includes the following steps:

ii.a) applying a sleeve film section to the lateral surfaces of the compressed filter tow bale, wherein the sleeve film section has a surface area and two opposite end regions;

ii.b) bringing together the opposite end regions of the sleeve film section; and ii.c) connecting the opposite end regions of the sleeve film section to one another and connecting the surface area of the sleeve film section to the bottom film section and the cover film section to produce the airtight packaging sleeve completely enclosing the compressed filter tow bale, wherein step ii.a) further includes applying the sleeve film section around the lateral surfaces of the compressed filter tow bale in such a way that at least 80% of the surface area of the sleeve film section does at least one of (1) directly adjoins and therefore contacts the compressed filter tow bale; and (2) is spaced apart from the compressed filter tow bale by less than 15 mm; and wherein the sleeve film section is in the form of a flat film;

wherein step ii.a) further includes applying the sleeve film section around the lateral surfaces of the compressed filter tow bale with an average application prestressing force of at least 50 N.

14. The method according to claim 13, wherein step i) further includes producing the compressed filter tow bale with a base adapted to the dimensions of a transport pallet and measuring at least 6,500 $cm^2$; and producing the compressed filter tow bale with a height of at least 75 cm and a bale density of at least 300 $kg/m^3$; and wherein step ii) further includes applying the airtight packaging sleeve to the lateral surfaces of the compressed filter tow bale in such a way that no more than 650 liters of air are contained in a volume enclosed by the sleeve film section, the cover film section and the bottom film section at a temperature of 20° C.

15. The method according to claim 14, wherein step ii.a) further includes applying the sleeve film section to the lateral surfaces of the compressed filter tow bale in such a way that no more than 50 liters of air are enclosed between the surface area of the sleeve film section and the compressed filter tow bale at a temperature of 20° C.

16. The method according to claim 13, wherein step ii.a) further includes applying the sleeve film section to the lateral surfaces of the compressed filter tow bale with the prestressing force in a horizontal direction.

17. A method for producing a packaged filter tow bale, wherein the method comprises the following steps:

i) producing a compressed filter tow bale in a baling press, the compressed filter tow bale having lateral surfaces; and ii) wrapping the compressed filter tow bale with an airtight packaging sleeve, which completely encloses the compressed filter tow bale, wherein step ii) further includes applying the airtight packaging sleeve to the compressed filter tow bale in such a way that at least 80% of the airtight packaging sleeve does at least one of: (1) directly adjoins and therefore contacts the compressed filter tow bale; and (2) is spaced apart from the compressed filter tow bale by less than 15 mm;

wherein step i) further includes producing the compressed filter tow bale between a cover film section and a bottom film section, and wherein step ii) further includes the following steps:

ii.a) applying a sleeve film section to the lateral surfaces of the compressed filter tow bale, wherein the sleeve film section has a surface area and two opposite end regions;

ii.b) bringing together the opposite end regions of the sleeve film section; and ii.c) connecting the opposite end regions of the sleeve film section to one another and connecting the surface area of the sleeve film section to the bottom film section and the cover film section to produce the airtight packaging sleeve completely enclosing the compressed filter tow bale, wherein step ii.a) further includes applying the sleeve film section around the lateral surfaces of the compressed filter tow bale in such a way that at least 80% of the surface area of the sleeve film section does at least one of (1) directly adjoins and therefore contacts the compressed filter tow bale; and (2) is spaced apart from the compressed filter tow bale by less than 15 mm; and wherein the sleeve film section is in the form of a flat film wherein step ii) further includes the following steps:

ii.d) producing a vertically extending weld seam in a vertical overlapping region formed when the opposite end regions of the sleeve film section are brought together;

ii.e) prestressing the sleeve film section in a direction of the vertically extending weld seam and fixing the sleeve film section in its prestressed state;

ii.f) producing a first peripheral horizontal overlapping region between an upper end region of the sleeve film section and a peripheral edge region of the cover film section and producing a second peripheral horizontal overlapping region between a lower end region of the sleeve film section and the peripheral edge region of the bottom film section; and ii.g) producing a peripheral weld seam in each of the peripheral horizontal overlapping regions, wherein the vertically extending weld seam and the peripheral weld seams in the peripheral horizontal overlapping regions are produced in such a way that the bottom film section, the cover film section and the sleeve film section form the airtight packaging sleeve, which completely encloses the compressed filter tow bale, and wherein step ii.e) further includes prestressing the sleeve film section with an average prestressing force of at least 50 N.

18. The method according to claim 17, wherein step ii.g) further includes producing the peripheral weld seam in the peripheral horizontal overlapping regions at a predefined-minimum distance from the compressed filter tow bale, wherein the predefined minimum distance lies in the range between 2 and 20 cm and wherein the predefined minimum distance between the peripheral weld seam and the compressed filter tow bale is dependent on at least one elastic restoration property of the compressed filter tow bale after the compressed filter tow bale is released from the baling press.

* * * * *